US006470647B2

(12) United States Patent
Hsueh

(10) Patent No.: US 6,470,647 B2
(45) Date of Patent: Oct. 29, 2002

(54) WALL BOARD ADJUSTMENT STRUCTURE

(76) Inventor: Yi-Cheng Hsueh, No. 28-1, Lane 195, Yung Fong Road, Tu Cheng, Taipei Hsien (TW)

( * ) Notice: Subject to any disclaimer, the term of this patent is extended or adjusted under 35 U.S.C. 154(b) by 62 days.

(21) Appl. No.: 09/820,907

(22) Filed: Mar. 30, 2001

(65) Prior Publication Data

US 2002/0005024 A1 Jan. 17, 2002

(30) Foreign Application Priority Data

Jul. 17, 2000 (TW) ..... 89212338 U

(51) Int. Cl.[7] ..... E04B 1/61
(52) U.S. Cl. ..... 52/764; 52/235; 52/480
(58) Field of Search ..... 52/235, 506.06, 52/506.08, 508, 241

(56) References Cited

U.S. PATENT DOCUMENTS 3,903,671 A * 9/1975 Cuin et al. ..... 52/480
4,625,481 A * 12/1986 Crandell ..... 52/235
5,481,839 A * 1/1996 Lang et al. ..... 52/235

* cited by examiner

*Primary Examiner*—Carl D. Friedman
*Assistant Examiner*—Steve Varner
(74) *Attorney, Agent, or Firm*—Troxell Law Office PLLC

(57) ABSTRACT

A wall board adjustment structure includes at least two brackets respectively fixedly fastened to the wall of a building at different elevations and aligned vertically in a line, the brackets each having a base panel fixedly fastened to the wall of the building, a support panel perpendicularly extended from the base panel, and a plurality of flanges perpendicularly upwardly extended from a top side of the support panel and defining a plurality of coupling grooves; a ribbed frame coupled to the brackets and disposed in parallel to the wall of the building, the ribbed frame having a flat base, back coupling means disposed a back side of the flat base, and front coupling means disposed at a front side of the flat base; at least two hanging plates respectively coupled between the back coupling means of the ribbed frame and the brackets to hold the ribbed frame in parallel to the wall of the building, the hanging plates each having a first hook flange hooked in one coupling groove of one bracket, and a second hook flange hooked in the back coupling means of the ribbed frame; and a plurality of wall boards respectively fastened to the front coupling means of the ribbed frames and abutted against one another.

10 Claims, 7 Drawing Sheets

V-V

VI-VI

WALL BOARD ADJUSTMENT STRUCTURE

BACKGROUND OF THE INVENTION

1. Field of the Invention

The present invention relates to a wallboard adjustment structure and, more particularly, to such a wallboard adjustment structure, which enables wallboards to be fastened to a non-vertical wall and kept in a flush manner.

2. Description of Related Art

Partition walls and screen systems are commonly used to separate a room or the indoor space of a building into separated spaces for different purposes. Different materials and modularized elements may be used for constructing partition walls or screen systems. However, it is difficult and complicated to set up a partition wall in a building in which the wall is not vertical. When setting up a partition wall on an oblique wall of a building, a vertical reference line is measured at first, and then support rods are installed in the oblique wall of the building to form a support frame subject to the vertical reference line, and then wall boards are respectively coupled to the support frame and kept in a flush manner. Only experienced technicians, for example, carpenters can do this construction.

SUMMARY OF THE INVENTION

The present invention has been accomplished to provide a wallboard adjustment structure, which eliminates the aforesaid problem.

According to one aspect of the present invention, the wall board adjustment structure comprises at least two brackets respectively fixedly fastened to the wall of a building at different elevations and aligned vertically in a line, the brackets each having a base panel fixedly fastened to the wall of the building, a support panel perpendicularly extended from the base panel, and a plurality of flanges perpendicularly upwardly extended from a top side of the support panel and defining a plurality of coupling grooves; a ribbed frame coupled to the brackets and disposed in parallel to the wall of the building, the ribbed frame having a flat base, back coupling means disposed a back side of the flat base, and front coupling means disposed at a front side of the flat base; at least two hanging plates respectively coupled between the back coupling means of the ribbed frame and the brackets to hold the ribbed frame in parallel to the wall of the building, the hanging plates each having a first hook flange hooked in one coupling groove of one bracket, and a second hook flange hooked in the back coupling means of the ribbed frame; and a plurality of wall boards respectively fastened to the front coupling means of the ribbed frames and abutted against one another.

According to another aspect of the present invention, a top fitting structure is provided to secure the ribbed frame to the ceiling of the building.

According to still another aspect of the present invention, a kick plate structure is provided to support the ribbed frame on the floor.

BRIEF DESCRIPTION OF THE DRAWINGS

The present invention can be more fully understood by referring to the following description ad accompanying drawing, in which.

DETAILED DESCRIPTION OF THE PREFERRED EMBODIMENTS

Figure 1:
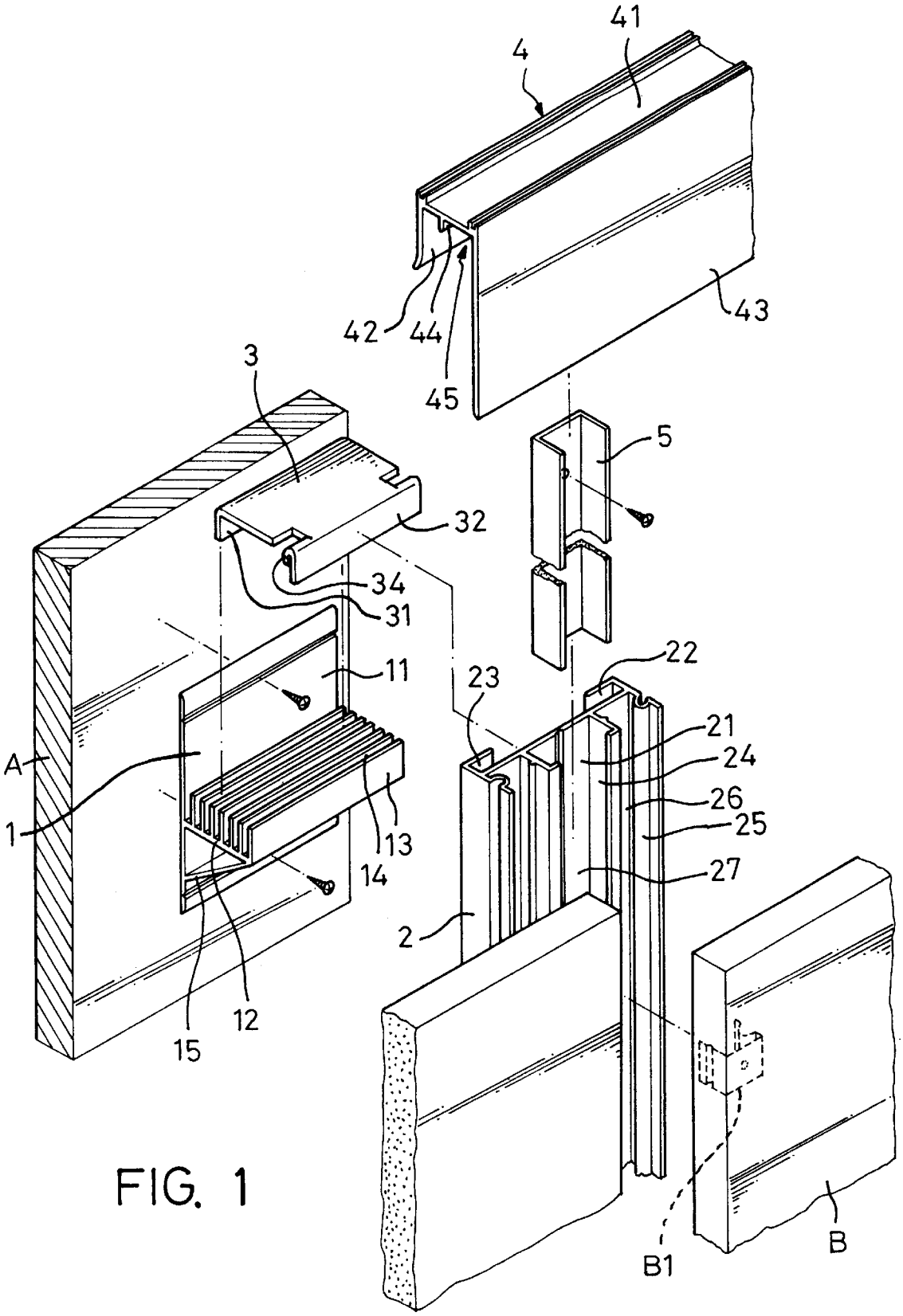
FIG. 1 is an exploded view of the present invention.
Figure 2:
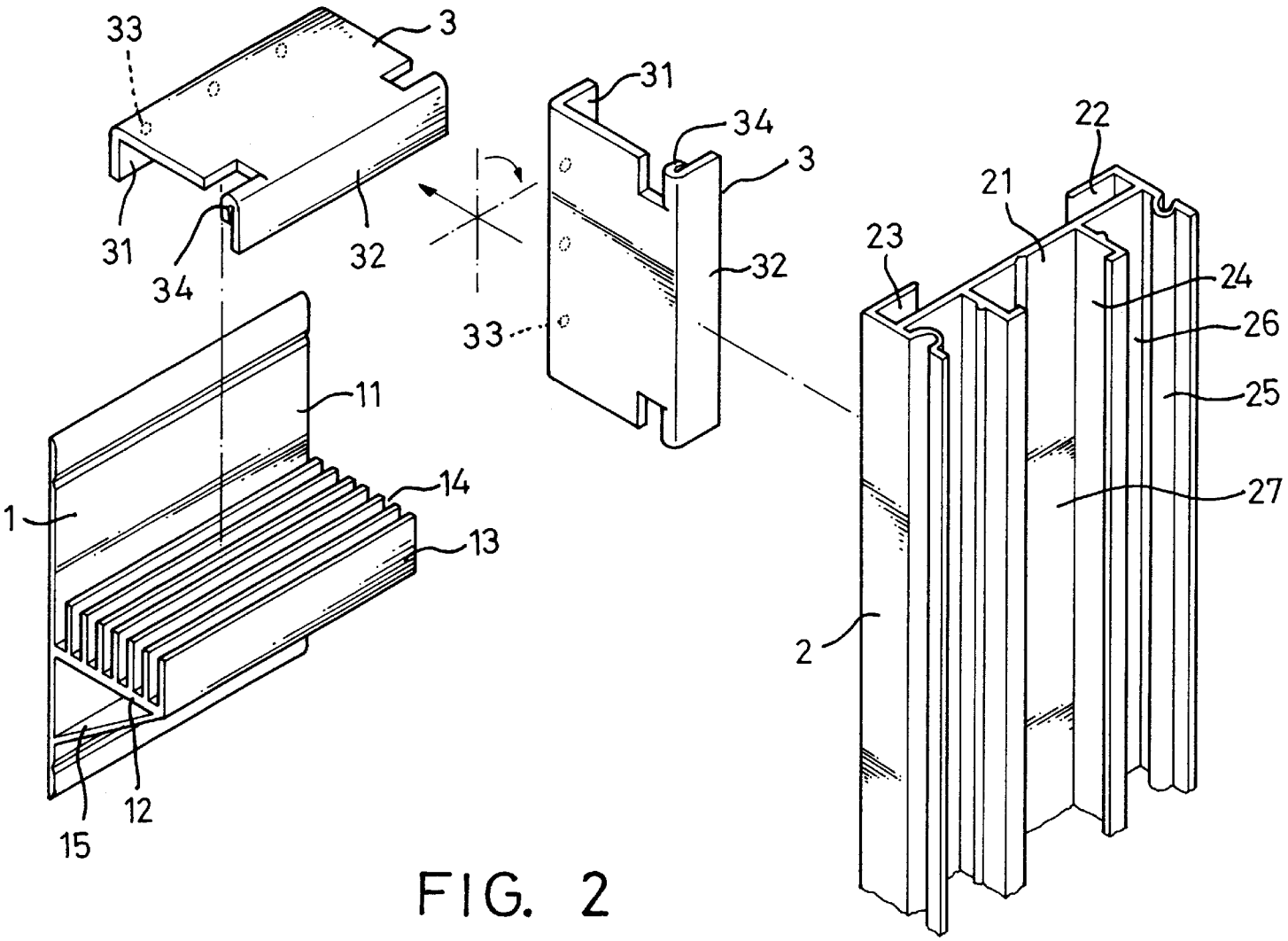
FIG. 2 illustrates the connection procedure of the present invention.

Referring to FIGS. 1 and 2, a wall board adjustment structure in accordance with the present invention comprises at least two brackets 1, a ribbed frame 2, and a plurality of hanging plates 3 corresponding to the brackets 1.

The bracket 1 comprises a base panel 11 fixedly fastened to the wall A near the top or bottom side, a support panel 12 perpendicularly extended from the base panel 11, a plurality of flanges 13 perpendicularly upwardly extended from the top side of the support panel 12 defining a plurality of coupling grooves 14 for the mounting of the corresponding hanging plate 3 selectively, and a reinforcing plate 15 obliquely connected between the base panel 11 and the support panel 12 at a bottom side.

The ribbed frame 2 is a narrow, elongated frame of equal cross-section, comprising a flat base 21, a back coupling unit formed of two back locating flanges 22 longitudinally disposed the back side of the flat base 21 and defining with the back sidewall of the flat base 21 a back coupling groove 23, two first front locating flanges 25 longitudinally extended along the front sidewall of the flat base 21, two second front locating flanges 24 longitudinally provided at the front sidewall of the flat base 21 and spaced between the first front locating flanges 25, two first front coupling grooves 26 respectively defined between the first front locating flanges 25 and the second front locating flanges 24 for the positioning of retaining plates B1 of wall boards B, and a second front coupling groove 27 defined between the second front locating flanges 24.

The hanging plate 3 is a flat frame plate comprising a first hook flange 31 adapted to hook in one coupling groove 14 of one bracket 1, a second hook flange 32 adapted to hook in the back coupling groove 23 of the ribbed frame 2, and two notched portions 34 disposed adjacent to the two distal ends of the second hook flange 32 for engagement with the back locating flanges 22 of the ribbed frame 2. The first hook flange 31 has a plurality of raised portions 33. Referring to FIG. 2, When fastening the hanging plate 3 to the ribbed frame 2, the second hook flange 32 is turned to a vertical position and attached to the back sidewall of the flat base 21 of the ribbed frame 2, and then the hanging plate 3 is rotated through 90° to force the notched portions 34 into engagement with the back locating flanges 22 of the ribbed frame 2, keeping the two distal ends of the second hook flange 32 retained to the back coupling groove 23 of the ribbed frame 2. After the second hook flange 32 of the hanging plate 3 has been coupled to the back coupling groove 23 of the ribbed frame 2, the hanging plate 3 can be moved longitudinally along the back coupling groove 23 of the ribbed frame 2 to force the first hook flange 31 into engagement with one coupling groove 14 of the corresponding bracket 1.

Figure 4A:
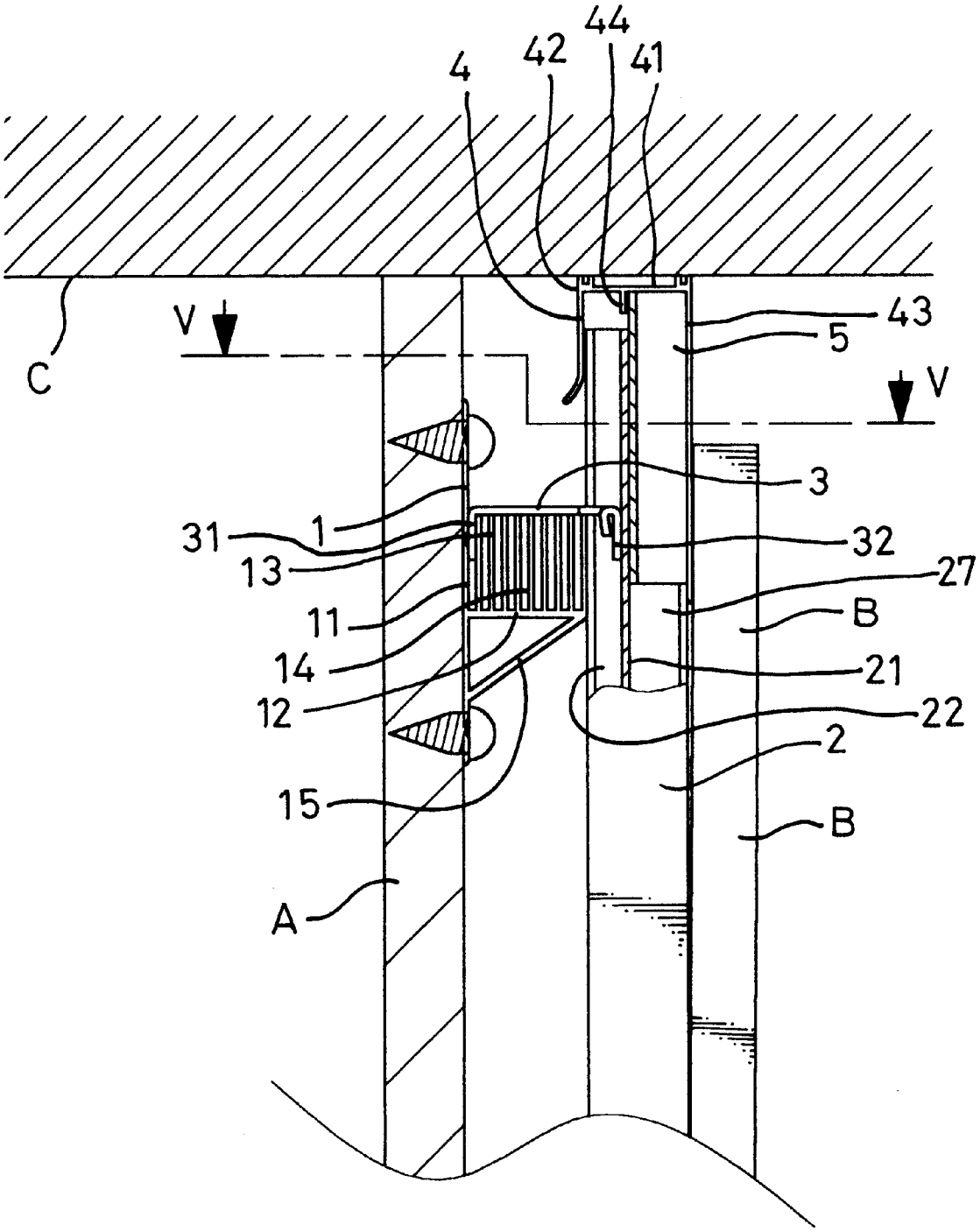
FIG. 4A is a sectional view showing the top fitting structure and the ribbed frame installed according to the present invention.
Figure 4B:
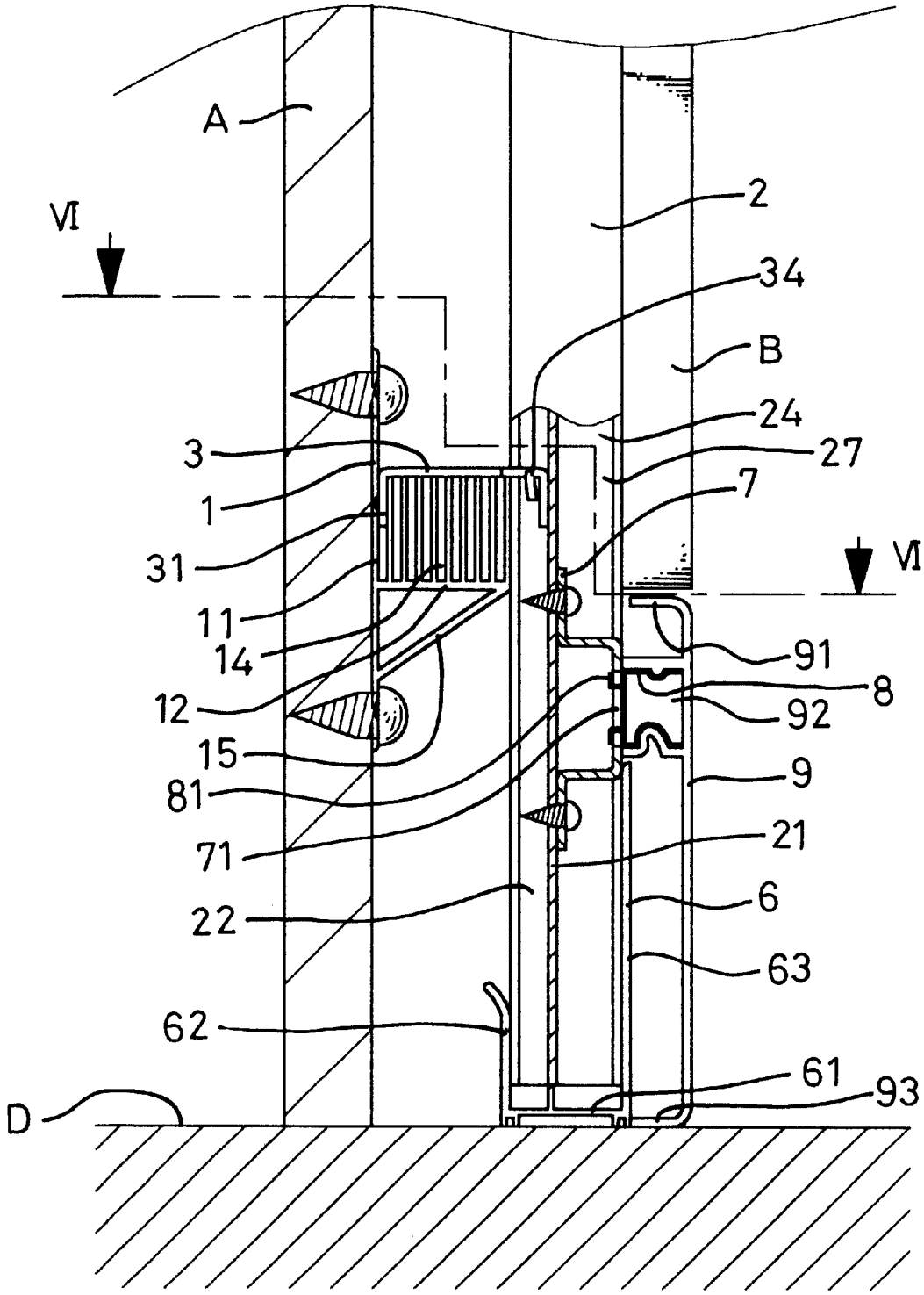
FIG. 4B is a sectional view showing the kick plate structure and the ribbed frame installed according to the present invention.

The installation of the present invention is outlined hereinafter with reference to FIGS. 4A and 4B. At first, draw a vertical reference line on the wall A, and then, the two brackets 1 are fixedly fastened to the wall A at different elevations along the vertical reference line, and then the two hanging plates 3 are respectively coupled to the back coupling groove 23 of the ribbed frame 2 subject to the aforesaid coupling procedure, and then the first hook flange 31 of each of the hanging plates 3 is respectively hooked in one coupling groove 14 of each of the brackets 1, and then the prepared wall boards B are respectively fastened to the first front coupling grooves 26 of the ribbed frame 2 by retaining plates B1.

Figure 5:
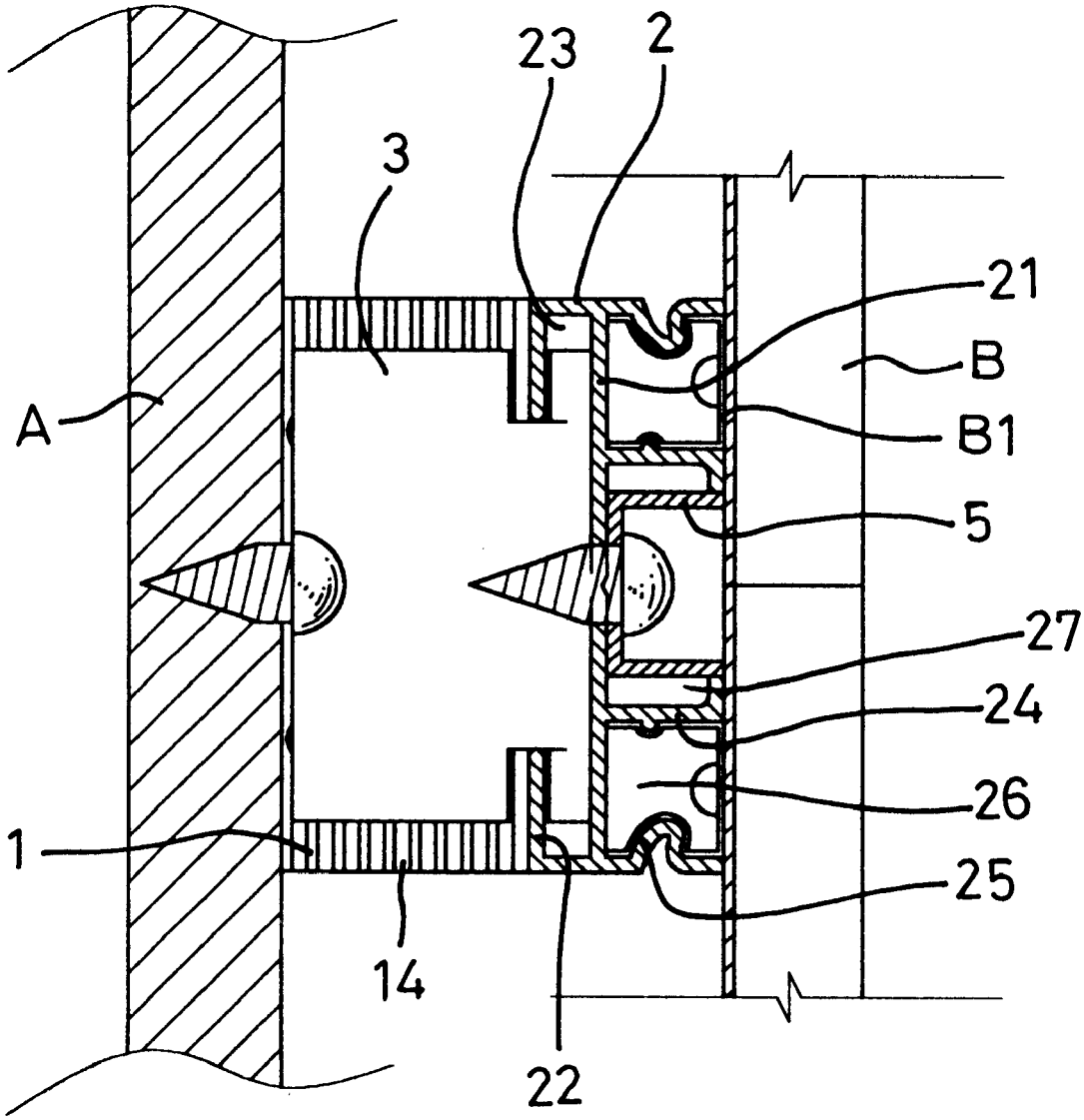
FIG. 5 is a sectional view taken along line V—V of FIG. 4A.

Referring to FIGS. 1, 4A and 5 again, in order to fit the height between the floor D and the ceiling C, a top fitting structure is provided and fastened to the ribbed frame 2 at the top. The top fitting structure comprises a bearing frame 4 and a mounting frame 5.

Wherein the bearing frame 4 comprises a narrow base 41 closely attached and fixedly fastened to the ceiling C, a short downward flange 42 and a long downward flange 43 respectively downwardly extended along two lateral sides of the narrow base 41 and adapted to clamp the ribbed frame 2, a longitudinal rib 44 downwardly extended from the narrow base 41 between the downward flanges 42 and 43 corresponding to the flat base 21 of the ribbed frame 2, and a coupling groove 45 defined between the long downward flange 43 and the longitudinal rib 44 and adapted to receive the mounting frame 5.

The mounting frame 5 fits the second front coupling groove 27 of the ribbed frame 2 and the coupling groove 45 of the bearing frame 4. During installation, the bearing frame 4 is fixedly fastened to the ceiling C, and then the mounting frame 5 is moved in the second front coupling groove 27 of the ribbed frame 2 to force the top end of the mounting frame 5 into engagement with the coupling groove 45 and into contact with the bottom surface of the narrow base 41 of the bearing frame 4, and then the bottom end of the mounting frame 5 is fixedly fastened to the ribbed frame 2. After installation of wallboards B, the top sided wallboards B keep the bearing frame 4 from sight.

Figure 3:
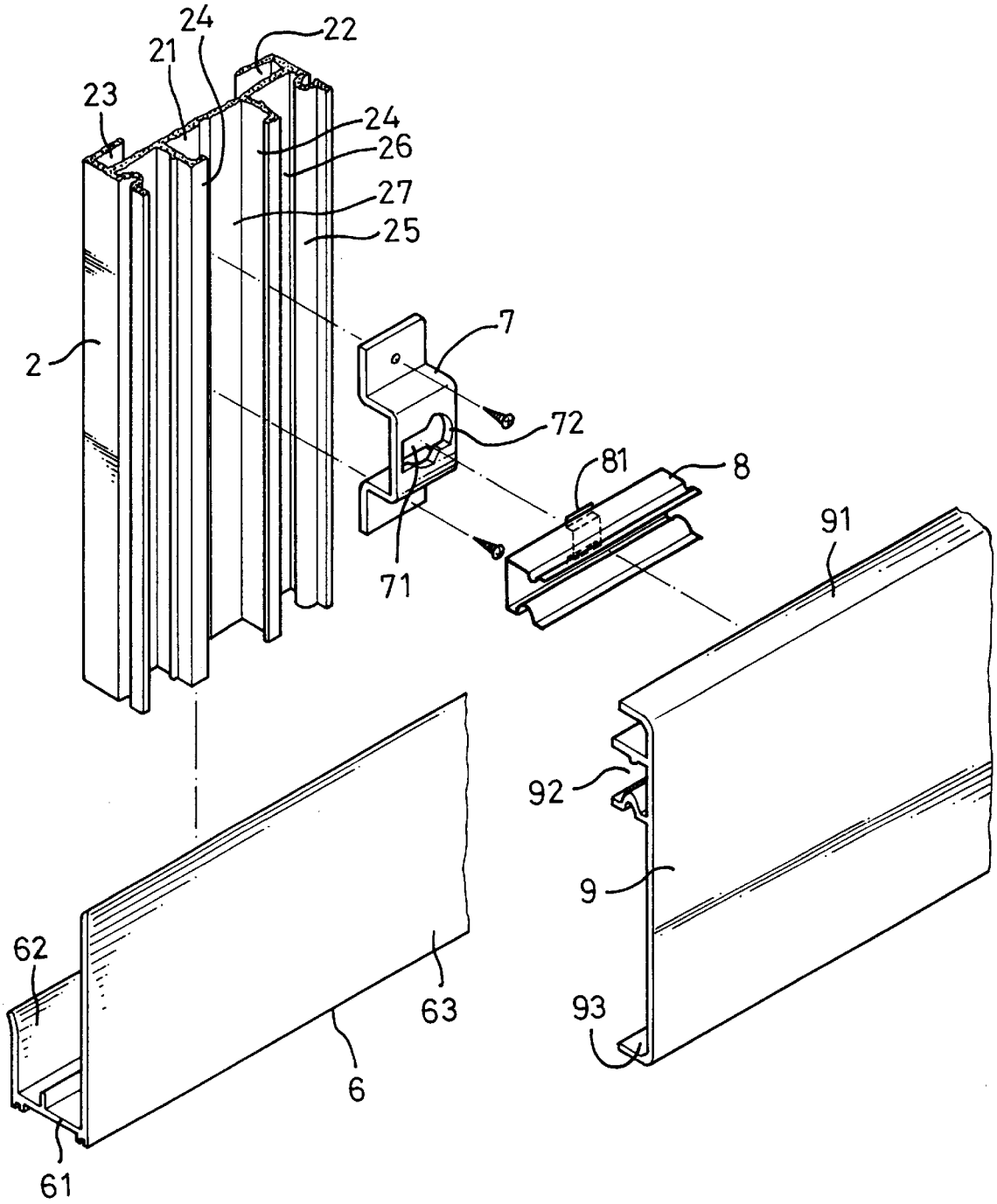
FIG. 3 is an exploded view of the ribbed frame and the kick plate structure according to the present invention.
Figure 6:
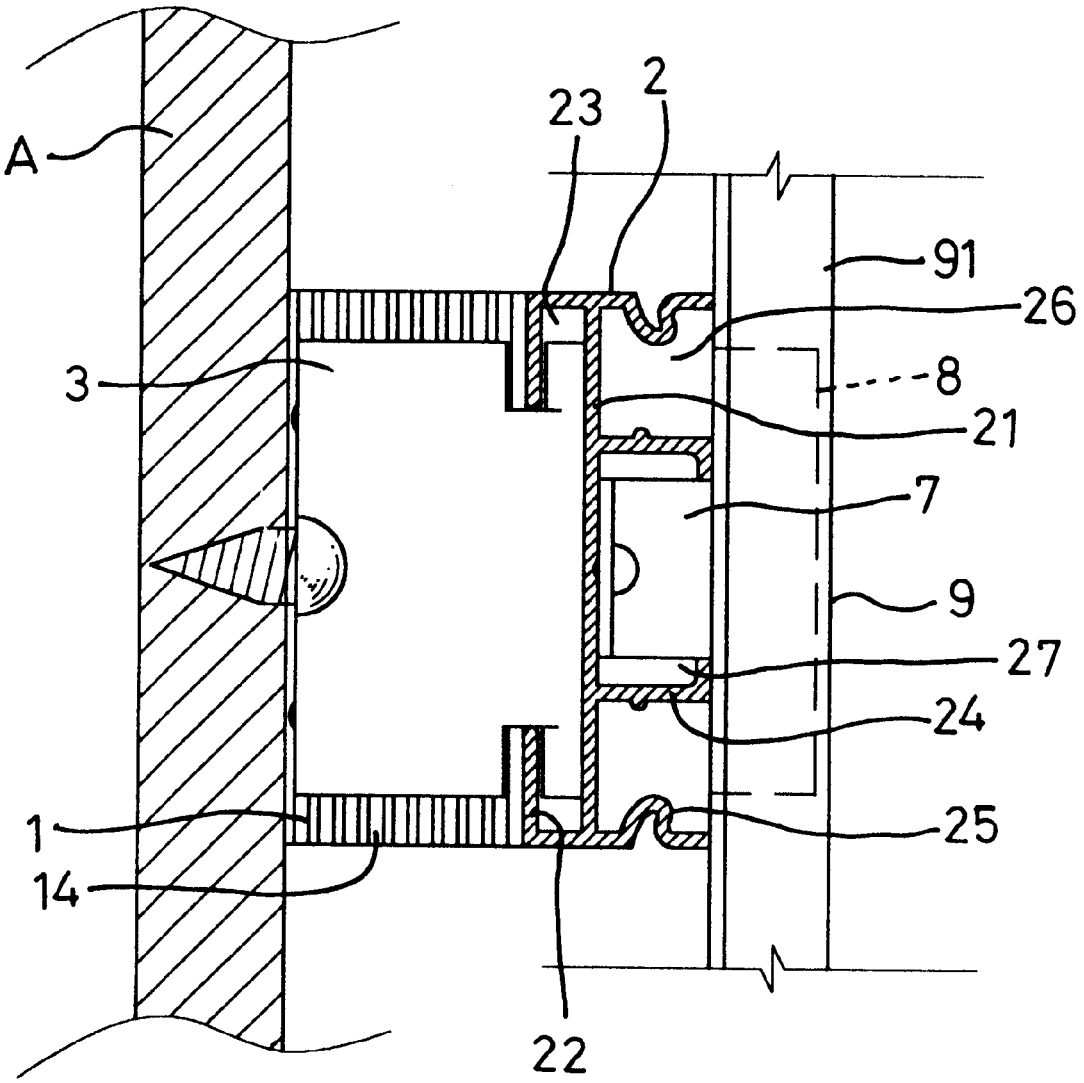
FIG. 6 is a sectional view taken along line VI—VI of FIG. 4B.

Referring to FIGS. 3, 4B and 6 again, in order to fit the uneven surface of the floor D, a kick plate adjustment structure is provided and fastened to the bottom side of the ribbed frame 2. The kick plate adjustment structure comprises a bearing frame 6, a coupling plate 7, a retaining plate 8, and a kick plate 9.

The bearing frame 6 is similar to the aforesaid bearing frame 4 but set in the reversed direction, comprising a narrow base 61 adapted to support the ribbed frame 2 on the floor D, and a short upward flange 62 and a long upward flange 63 respectively upwardly extended along two lateral sides of the narrow base 61 and adapted to clamp the ribbed frame 2.

The coupling plate 7 is a substantially rectangular frame plate fitting the second front coupling groove 27 of the ribbed frame 2 and fixedly fastened to the second front coupling groove 27 above the long upward flange 63 of the bearing frame 6, comprising a retaining hole 71 and an oblique insertion hole 72 linked to one end of the retaining hole 71.

The retaining plate 8 is a front-open frame comprising two retaining lugs 81 protruded from the back sidewall thereof. During installation, the retaining lugs 81 are inserted into the oblique insertion hole 72, and then the retaining plate 8 is turned in one direction to force the retaining lugs 81 into engagement with the retaining hole 71. When installed, the coupling plate 7 and the retaining plate 8 are disposed at right angles.

The kick plate 9 is an elongated member comprising a longitudinally extended top bearing flange 91 adapted to support wall boards B, a bottom bearing flange 93 supported on the floor D and perpendicularly attached to the long upward flange 63 of the bearing frame 6, and two longitudinally extended retaining flanges 92 adapted to secure the retaining plate 8.

In case the floor D between two ribbed frames 2 is not horizontal, a horizontal reference line is obtained between the two ribbed frames 2, and then two coupling plates 7 are respectively fixedly fastened to the second front coupling groove 27 of each of the two ribbed frames 2 subject to the horizontal reference line, and then two retaining plates 8 are respectively fastened to the coupling plates 7, and then a kick plate 9 is coupled to the retaining plates 8. Because the bottom bearing flange 93 is perpendicularly attached to the long upward flange 63 of the bearing frame 6, the gap between the obliquely disposed bottom bearing flange 93 of the kick plate 9 and the non-horizontal floor D is blocked by the long upward flange 63 of the bearing frame 6.

A prototype of wallboard adjustment structure has been constructed with the features of FIGS. 1 through 6. The wallboard adjustment structure functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A wall board adjustment structure comprising:

at least two brackets respectively fixedly fastened to the wall of a building at different elevations and aligned vertically in a line, said brackets each comprising a base panel fixedly fastened to the wall of the building, a support panel perpendicularly extended from said base panel, and a plurality of flanges perpendicularly upwardly extended from a top side of said support panel and defining a plurality of coupling grooves;

a ribbed frame coupled to said brackets and disposed in parallel to the wall of the building, said ribbed frame comprising a flat base, back coupling means disposed a back side of said flat base, and front coupling means disposed at a front side of said flat base;

at least two hanging plates respectively coupled between the back coupling means of said ribbed frame and said brackets to hold said ribbed frame in parallel to the wall of the building, said hanging plates each comprising a first hook flange hooked in one coupling groove of one bracket, and a second hook flange hooked in said back coupling means of said ribbed frame; and a plurality of wallboards respectively fastened to the front coupling means of said ribbed frames and abutted against one another.

2. The wall board adjustment structure of claim 1 wherein said brackets each further comprise a reinforcing plate obliquely connected between the respective base panel and the respective support panel at a bottom side.

3. The wall board adjustment structure of claim 1 wherein said back coupling means of said ribbed frame comprises two back locating flanges longitudinally disposed the back side of said flat base and defining with said flat base a back coupling groove, and the second hook flange of each of said hook plates is respectively hooked in said back coupling groove.

4. The wall board adjustment structure of claim 3 wherein said hanging plates each comprise two notched portions disposed adjacent to two distal ends of the respective second hook flange for engagement with the back locating flanges of said ribbed frame.

5. The wall board adjustment structure of claim 1 wherein said first hook flange front has a plurality of raised portions.

6. The wall board adjustment structure of claim 1 further comprising a top fitting structure adapted to secure said ribbed frame to the ceiling of the building, said top fitting structure comprising:

a bearing frame, said bearing frame comprising a narrow base attached and fixedly fastened to the ceiling of the building, a short downward flange and a long downward flange respectively downwardly extended along two lateral sides of said narrow base and clamped on said ribbed frame at a top side, a longitudinal rib downwardly extended from said narrow base between the downward flanges of said bearing frame corresponding to the flat base of said ribbed frame, and a coupling groove defined between said long downward flange and said longitudinal rib; and a mounting frame connected between said ribbed frame and said bearing frame, said mounting frame having a bottom end fitted into a coupling groove defined in said front coupling means of said ribbed frame and fixedly secured thereto and a top end perpendicularly fitted into the coupling groove of said bearing frame.

7. The wall board adjustment structure of claim 6 wherein said long downward flange of said bearing frame of said top fitting structure is retained between said ribbed frame and said wall boards.

8. The wallboard adjustment structure of claim 1 further comprising a kick plate structure, said kick plate structure comprising:

a bearing frame adapted to support said ribbed frame on the floor of the building, the bearing frame of said kick plate structure comprising a narrow base adapted to support said ribbed frame on the floor of the building, and a short upward flange and a long upward flange respectively upwardly extended along two lateral sides of the narrow base of said bearing frame and clamped on said ribbed frame at a bottom side;

a coupling plate fixedly fastened to said front coupling means of said ribbed frame, said coupling plate comprising a retaining hole;

a retaining plate coupled to said coupling plate, said retaining plate comprising two retaining lugs protruded from a back sidewall thereof and inserted through the oblique insertion hole of said coupling plate and forced into engagement with said retaining hole of said coupling plate; and a kick plate attached to the bearing frame of said kick plate structure and coupled to said coupling plate, said kick plate comprising a longitudinally extended top bearing flange adapted to support said wall boards, a bottom bearing flange supported on the floor of the building and perpendicularly attached to the long upward flange of the bearing frame of said kick plate structure, and two longitudinally extended retaining flanges coupled to said retaining plate.

9. The wall board adjustment structure of claim 8 wherein said coupling plate of said kick plate structure comprises an oblique insertion hole linked to one end of said retaining hole adapted to receive the retaining lugs of said retaining plate for enabling the retaining lugs of said retaining plate to be forced into engagement with said retaining hole upon a rotary motion of said retaining plate after insertion of the retaining lugs of said retaining plate into said oblique insertion hole.

10. The wall board adjustment structure of claim 1 wherein said wallboards are block-like members or flat plate members.

* * * * *